United States Patent [19]

Huang

[11] Patent Number: 5,003,898

[45] Date of Patent: Apr. 2, 1991

[54] DRIVING STRUCTURE FOR MINI-SEWING MACHINE

[76] Inventor: Dennis Huang, 2F, No. 1, Lane 9, Ningpo E. Street, Taipei, Taiwan

[21] Appl. No.: 318,599

[22] Filed: Mar. 3, 1989

[51] Int. Cl.[5] ..... D05B 69/00

[52] U.S. Cl. ..... 112/220; 112/221

[58] Field of Search ..... 112/80.03, 80.04, 169, 112/220, 221, 2

[56] References Cited

U.S. PATENT DOCUMENTS

| | | | |
|---|---|---|---|
| 3,094,955 | 6/1963 | Fischbein et al. | 112/169 |
| 3,745,950 | 7/1973 | Kato | 112/169 |

FOREIGN PATENT DOCUMENTS

| | | | |
|---|---|---|---|
| 3283694 | 11/1988 | Japan | 112/221 |
| 3283695 | 11/1988 | Japan | 112/221 |
| 2173825 | 10/1986 | United Kingdom | 112/2 |

*Primary Examiner*—Peter Nerbun
*Assistant Examiner*—Paul C. Lewis
*Attorney, Agent, or Firm*—Bucknam and Archer

[57] ABSTRACT

An improved driving structure for a mini-sewing machine, includes an elongated frame body having a front end and a rear end, a sewing needle which may be rigidly connected to the front end of the elongated frame body, and is arranged to operatively point downwards. A sliding block is pivotably connected to the rear end of the elongated frame body, and is formed with an elongated slot near its lower end. A driving gear and a cap are disposed on respective opposite sides of the sliding block. A coupling mechanism couples the driving gear to the cap; first and second portions of a guiding mechanism are eccentrically located on the driving gear and on the cap, respectively, and are coupled to one another through the elongated slot of the sliding block for operatively imparting a reciprocal movement to the sliding block, and thereby also to the sewing needle. A driving mechanism operatively rotates the driving gear, and is adapted to be driven by a motor.

11 Claims, 2 Drawing Sheets

DRIVING STRUCTURE FOR MINI-SEWING MACHINE

BACKGROUND OF THE INVENTION.

The invention of the sewing machine changed the method of manufacturing garments, and helped to establish a garment industry. Consequently, the so-called "one needle with one thread" motto of the traditional style of making clothes has vanished into history.

The original sewing machine, like the other industrial products of the same era, was operated by human power. The typical sewing machines in the 1950's were operated by means of a foot pedal. However, after a certain amount of pedaling has taken place, the operator tired easily. Due to the daily pedaling, the calf muscles became well developed, and a professional tailor could readily be identified by such well developed calf muscles.

Some years following the invention of the first foot-operated sewing machine, electric power replaced human power. This revolution significantly improved the operation of the sewing machines and drastically reduced the consumption of human power. Hence motorized sewing machines replaced the traditional foot-pedal operated sewing machines of the earlier era.

In addition to industrial sewing machines for the mass manufacture of garments, motorized sewing machines for home use, which were, however, relatively heavy, became available. In a further developmental step, a more portable hand-held sewing machine, operated by means of a D.C. motor, appeared on the market.

Because of the compactness of the latter type of sewing machine, its easy operability and convenience in terms of the power supply, it became very popular with housewives. A typical mini-sewing machine of this type was described about 13 years ago in Chinese Pat. No. 7227261.

Both the traditional, and the conventional mini-sewing machine were provided with a driving mechanism which included a gear mounted on the revolving shaft of a D.C. motor, so as to engage a large steering gear, which latter drove another even larger gear. A crank shaft connected that still larger gear to the frame body. The rotation of the motor was thus converted to a vertical reciprocating movement suitable for the sewing process.

Even though the conventional mini-sewing machine is compact and easy to operate, it still has some drawbacks, which are further enumerated hereinbelow.

(1) High rate of power loss. The more transmission gears are employed, the greater the power loss due to unavoidable friction losses, and the greater the power required to operate the machine.

(2) A multiple number of gears leads to greater wear and tear on individual gears, and the cumulative wear and tear is even greater still, and after a certain time, interferes with a smooth sewing operation.

(3) The increased wear and tear enumerated in the previous paragraph eventually leads to a breakdown of the entire machine.

SUMMARY OF THE INVENTION

The present invention aims to eliminate or at least reduce the afore-mentioned drawbacks. This is achieved by an improved driving structure for a mini-sewing machine, which includes an elongated frame body having a front end and a rear end, and wherein a sewing needle may be rigidly connected to the front end of the elongated frame body, and arranged to operatively point downwards. A sliding block is pivotably connected to the rear end of the elongated frame body, and is formed with an elongated slot near its lower end. A driving gear and a cap are disposed on respective opposite sides of the sliding block. A fork or the like extending from the frame body permits coupling of the driving gear to the cap; first and second portions of a guiding mechanism are eccentrically located on the driving gear and on the cap, respectively, and are coupled to one another through the elongated slot of the sliding block for operatively imparting a reciprocal movement to the sliding block, and hence to the needle. A driving mechanism rotates the driving gear, and is adapted to be driven by a motor. In a further development of the present invention, it is advantageous, if the driving mechanism includes a steering shaft having an output gear engageable with the driving gear near one end of the steering shaft.

It is further beneficial if the steering shaft is adapted to be journalled in the mini-sewing machine, and if the driving mechanism includes a steering gear near an opposite end of the steering shaft, and is adapted to be engaged with the motor.

Advantageously the frame housing is formed with holes facing, and being aligned with one another, the driving gear is formed with an outwardly facing concentric stub., and the cap is formed with another outwardly facing concentric stub, and wherein the stubs may be rotatably engaged with respective of the holes formed in the frame housing. As the radial distance of the center of the driving gear to the outermost peripheral point of the driving axle located on the driving gear is slightly less than one half of the length the slot in the sliding block, the diameter of the driving gear needs only slightly exceed the length of the elongated slot formed in the sliding block.

It is also beneficial if the guiding mechanism includes a driving axle eccentrically disposed on the driving gear, and an aperture aligned with the driving axle formed in the cap for receiving the driving axle passing through the elongated slot in the sliding block.

Advantageously the driving structure for the elongated frame body includes a pivot mechanism near a center thereof so as to be pivotally connectable to the mini-sewing machine.

In a preferred embodiment the cap is circular, and the sliding block has a triangular configuration.

BRIEF DESCRIPTION OF THE DRAWINGS.

The present invention will be better understood with the aid of the drawings, in which.

DETAILED DESCRIPTION OF THE PREFERRED EMBODIMENT.

Figure 1A:
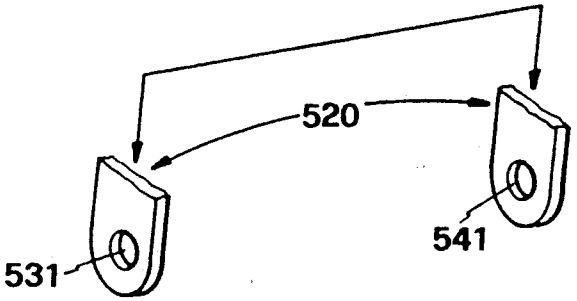
FIG. 1*a* is a perspective fragmentary portion of the frame body cooperating with the driving structure of the present invention.
Figure 1:
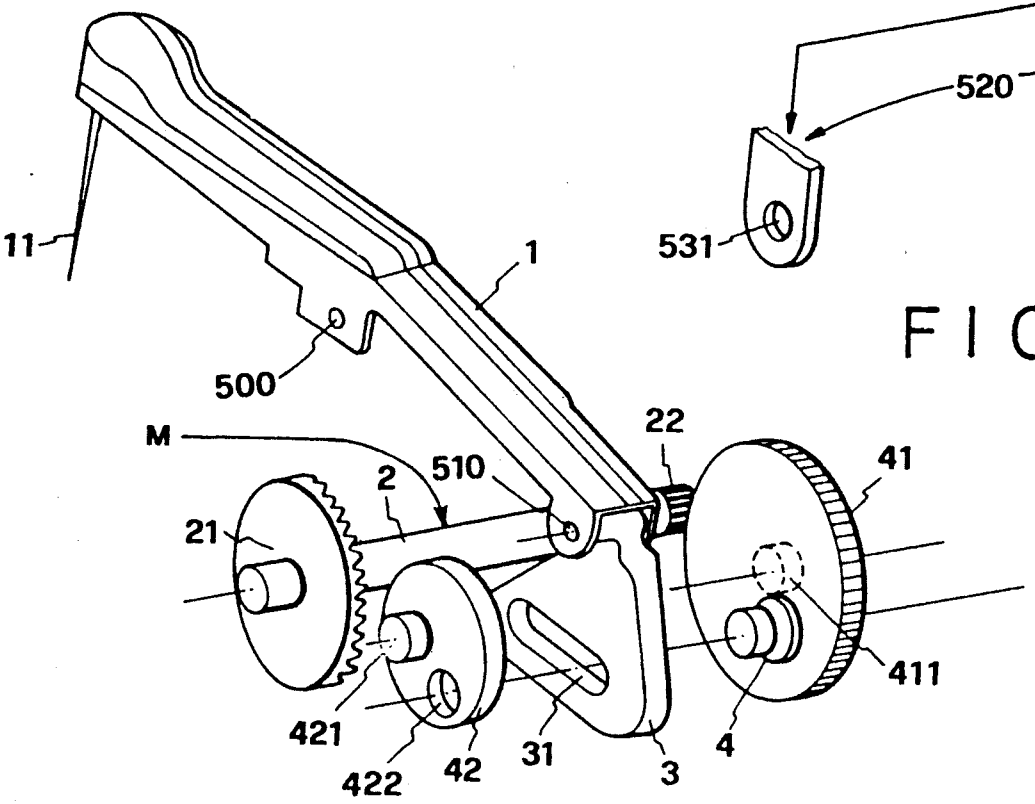
FIG. 1 is a perspective fragmentary view of the driving structure according to the present invention.
Figure 2:
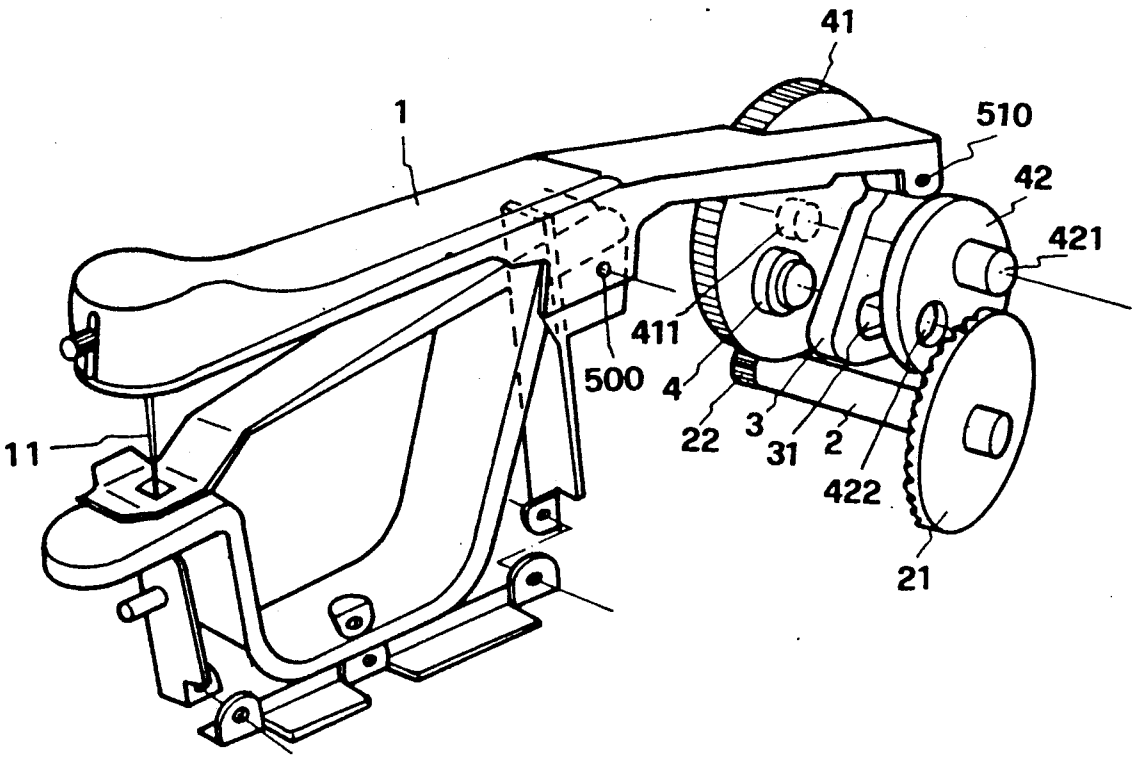
FIG. 2 is a perspective assembled view of the driving structure according to the present invention.

As can be seen from the accompanying FIGS. 1 and 2, an elongated frame body (1) which has a front end and a rear end, can be fitted with a sewing needle (11) rigidly connected to the front end of the elongated frame body (1), and which is arranged to operatively point downwards. A triangularly shaped sliding block (3) is pivotably connected to the rear end of the elongated frame body (1) near an apex of the sliding block (3), such as by pivot means (510), and the sliding block (3) is formed with an elongated slot (31) near a lower end or base thereof. The sliding block (3) may be shaped to substantially take the form of an isosceles triangle, and preferably of an equilateral triangle, so that a compact driving structure can be realized.

A pivot means (500) near the center of the elongated frame body (1) serve to pivot the latter body on the sewing machine. A driving gear (41) and a circular cap (42) are disposed on respective opposite sides of the sliding block (3).

Coupling means in the form of an outwardly facing concentric stub tenon (421) located on the circular cap (42), and another outwardly facing stub tenon (411) located on the driving gear (41), with both stubs being rotatably engageable in the frame housing, are provided for coupling the driving gear (41) to the circular cap (42) through the frame body (1).

A fragmentary portion of the frame housing in the form of a fork or the like is shown in FIG. 1*a*. The fork has two resilient members (520) formed with respective holes (531) and (541) aligned with one another, and the stubs (421) and (422) are rotatably engageable with the holes (531) and (541), respectively.

Guiding means in the form of a driving axle (4) eccentrically located on the driving gear (41), and an aperture (422) formed in the circular cap (42), respectively, are coupled to one another through the elongated slot (31) of the sliding block (3) for imparting a reciprocal movement to the sliding block (3). Hence the diameter of the driving gear (41) need only slightly exceed the length of the elongated slot (31).

Driving means in the form of (i) a steering shaft (2) adapted to be journalled in the mini-sewing machine, (ii) an output gear (22) on one end of the steering shaft (2), which in turn engages the driving gear (41), and (iii) a steering gear (21) on the other end of the steering shaft, (2), which, in turn, is adapted to engage a motor (M), are provided for operatively rotating the driving gear (41). The steering gear (21) is adapted to be driven by the motor.

The device operates as follows: When the output gear of a (non-illustrated) motor engages the steering gear (21) of the steering shaft (2), the driving gear (41) is also rotated. The eccentrically located driving axle (4), passing through the elongated slot (31) of the sliding block (3), causes the sliding block (3) to execute an oscillating movement about the pivot axis (510), which is only possible if the pivot axis (510) simultaneously executes a reciprocating movement substantially along a vertical direction, taking the elongated frame body (1) therealong. This, in turn, causes and up-and-down movement of the sewing needle (11). It will be noted that the locus, or freedom of movement of the driving axle (4) in the elongated slot (31) formed in the sliding block (3) is limited to a single-dimensional linear reciprocal movement, within, and relative to the elongated slot (31).

As described hereinabove, the present invention provides a driving structure for a D.C. powered mini-sewing machine with attendant advantages, such as more efficient operation, minimizing power loss, reduction of the rate of mechanical breakdown, lighter weight, and improved performance.

Recognizing that the structure described hereinabove may be modified in various manners to provide substantially identical results, the scope of the invention shall be deemed to be defined by the claims as set forth below.

I claim:

1. An improved driving structure for a mini-sewing machine, comprising in combination:

an elongated frame body having a front end and a rear end, a sewing needle rigidly connectable to the front end of said elongated frame body, and arranged to operatively point downwardly, a sliding block having a pivotal connection to the rear end of said elongated frame body, and being formed with an elongated slot of a predetermined length near a lower end thereof, a driving gear of a prearranged diameter exceeding the length of said elongated slot, and a cap disposed on respective opposite sides of said sliding block, coupling means for coupling said driving gear to said cap, guiding means eccentrically located on said driving gear and on said cap, respectively, and coupled to one another through the elongated slot of said sliding block for operatively imparting a reciprocal movement to said sliding block, and driving means for operatively rotating said driving gear, and being adapted to be driven by a motor.

2. The driving structure according to claim 1, wherein said driving means include a steering shaft having an output gear engageable with said driving gear near one end of said steering shaft.

3. The driving structure according to claim 2, wherein said steering shaft is adapted to be journalled in said mini-sewing machine.

4. The driving structure according to claim 3, wherein said driving means include a steering gear near on the opposite end of said steering shaft, and being adapted to be engaged with said motor.

5. The driving structure according to claim 1, wherein said frame housing is formed with holes aligned with, and facing one another, and said coupling means include said frame housing, said driving gear being formed with an outwardly facing concentric stub, and said cap being formed with another outwardly facing concentric stub, said stubs being rotatably engageable with a respective one of said holes formed in said frame housing.

6. The driving structure according to claim 1, wherein said guiding means include a driving axle eccentrically disposed on said driving gear, an aperture aligned with said driving axle being formed in said cap for receiving said driving axle passing through said elongated slot in said sliding block, whereby the freedom of movement of said driving axle in said elongated slot is limited to a single-dimensional linear reciprocal movement with, an relative to said elongated slot.

7. The driving structure according to claim 1, wherein said elongated frame body includes pivot means at a center thereof for being pivotally connectable to the mini-sewing machine.

8. The driving structure according to claim 1, wherein said cap is circular.

9. The driving structure according to claim 1, wherein said sliding block has a triangular configuration.

10. The driving structure according to claim 1, wherein said sliding block takes substantially the shape of an isosceles triangle, said pivotable connection to the rear end of said elongated body occuring near an apex of said isosceles triangle, said elongated slot extending in parallel with a base of said isosceles triangle, whereby said driving structure is made to be relatively compact.

11. The driving structure according to claim 10, wherein said sliding block takes the shape of an equilateral triangle.

* * * * *